US009335662B2

(12) United States Patent
Kadota et al.

(10) Patent No.: US 9,335,662 B2
(45) Date of Patent: May 10, 2016

(54) DEVELOPING DEVICE AND IMAGE FORMING APPARATUS AND PROCESS CARTRIDGE INCORPORATING SAME

(71) Applicants: Ichiro Kadota, Kanagawa (JP); Takahiro Adachi, Kanagawa (JP)

(72) Inventors: Ichiro Kadota, Kanagawa (JP); Takahiro Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/159,395

(22) Filed: Jan. 20, 2014

(65) Prior Publication Data

US 2014/0212180 A1 Jul. 31, 2014

(30) Foreign Application Priority Data

Jan. 29, 2013 (JP) ..... 2013-014465
Jan. 29, 2013 (JP) ..... 2013-014474

(51) Int. Cl.
*G03G 15/08* (2006.01)

(52) U.S. Cl.
CPC ..... *G03G 15/0893* (2013.01)

(58) Field of Classification Search
CPC ..... G03G 15/0865
USPC ..... 399/252, 254, 256
See application file for complete search history.

(56) References Cited

U.S. PATENT DOCUMENTS

| | | | | |
|---|---|---|---|---|
| 7,957,677 | B2 * | 6/2011 | Miyata | 399/253 |
| 2006/0280529 | A1 * | 12/2006 | Nakagawa et al. | 399/281 |
| 2007/0098449 | A1 | 5/2007 | Kadota et al. | |
| 2007/0160395 | A1 | 7/2007 | Kosugi et al. | |
| 2010/0226690 | A1 | 9/2010 | Kadota et al. | |
| 2011/0176820 | A1 | 7/2011 | Kadota et al. | |

FOREIGN PATENT DOCUMENTS

| | | |
|---|---|---|
| JP | 2007-148053 | 6/2007 |
| JP | 2007-264105 | 10/2007 |
| JP | 2010-204343 | 9/2010 |

* cited by examiner

*Primary Examiner* — Erika J Villaluna
(74) *Attorney, Agent, or Firm* — Duft Bornsen & Fettig LLP

(57) ABSTRACT

A developing device includes a developer bearer to carry developer, a first developer compartment from which developer is supplied to the developer bearer, a second developer compartment from which developer is sent to the first developer compartment, and first and second communicating portions through which developer is circulated between the first and second developer compartments. The second communicating portion to send developer from the second developer compartment to the first developer compartment is constructed of multiple openings.

17 Claims, 9 Drawing Sheets

ϕ5mm × 5

ϕ1.5mm 1.5mm × 1.5mm

1mm × 20mm

12mm × 1mm

SHORT SIDE LENGTH:1.5mm

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119 to Japanese Patent Application Nos. 2013-014465 and 2013-014474, both filed on Jan. 29, 2013, in the Japan Patent Office, the entire disclosure of each of which is hereby incorporated by reference herein.

BACKGROUND OF THE INVENTION

1. Technical Field

The present invention generally relates to a developing device used in electrophotographic image formation and to a process cartridge and an image forming apparatus, such as, a copier, a printer, a facsimile machine, a plotter, or a multifunction peripheral (MFP) or multifunction machine having at least two of coping, printing, facsimile transmission, plotting, and scanning capabilities, that includes the developing device.

2. Description of the Background Art

In electrophotographic image forming apparatuses, such as copiers, printers, facsimile machines, or multifunction machines, low-temperature image fixing is promoted to reduce impact on environment. Accordingly, there is an increasing possibility that developer (i.e., toner) coagulates inside a toner bottle, a toner replenishing device, or a developing unit when the temperature therein rises during image forming operation or it is left under hot and humid conditions.

When scooped onto a developing sleeve and used in image development, the coagulated developer (i.e., aggregates) results in substandard images including image failure such as spots, shooting star marks, white lines, or the like. To prevent spots, shooting star marks, white lines, or the like, for example, the following approaches have been tried.

1. Use moisture-proof packaging materials to prevent developer coagulation in toner bottles left for a long time under hot and humid conditions;

2. Use ball bearings having a good slidability or metal shaft screws to prevent developer coagulation caused by temperature rise when the developing unit is operated consecutively;

3. Increase image output intervals to cool the apparatus when the temperature inside the apparatus reaches a threshold;

4. Rotate a developer bearer in reverse to loosen coagulated developer stuck between the developer bearer and a developer regulator (see JP-2010-204343-A).

Further, JP-2007-264105-A proposes providing a filter in a communicating portion between two developer conveyance channels that are parallel to each other at least in a certain range. The filter can be a mesh having mesh openings that are three times to twenty times greater in size than toner particles, and aggregates can be loosened by filtering.

SUMMARY OF THE INVENTION

In view of the foregoing, one embodiment of the present invention provides a developing device that includes a developer bearer to carry developer, a first developer compartment from which developer is supplied to the developer bearer, a second developer compartment from which developer is sent to the first developer compartment, and first and second communicating portions through which developer is circulated between the first and second developer compartments. Through the second communicating portion, developer is sent from the second developer compartment to the first developer compartment, and the second communicating portion is constructed of multiple openings.

Another embodiment provides a process cartridge that is removably installable in an image forming apparatus and includes the above-described developing device and a unit casing to hold the developing device and at least one of an image bearer, a charging member to charge the image bearer, and a cleaning unit to clean the image bearer.

Yet another embodiment provides a an image forming apparatus that includes an image bearer on which an image is formed, and the above-described developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
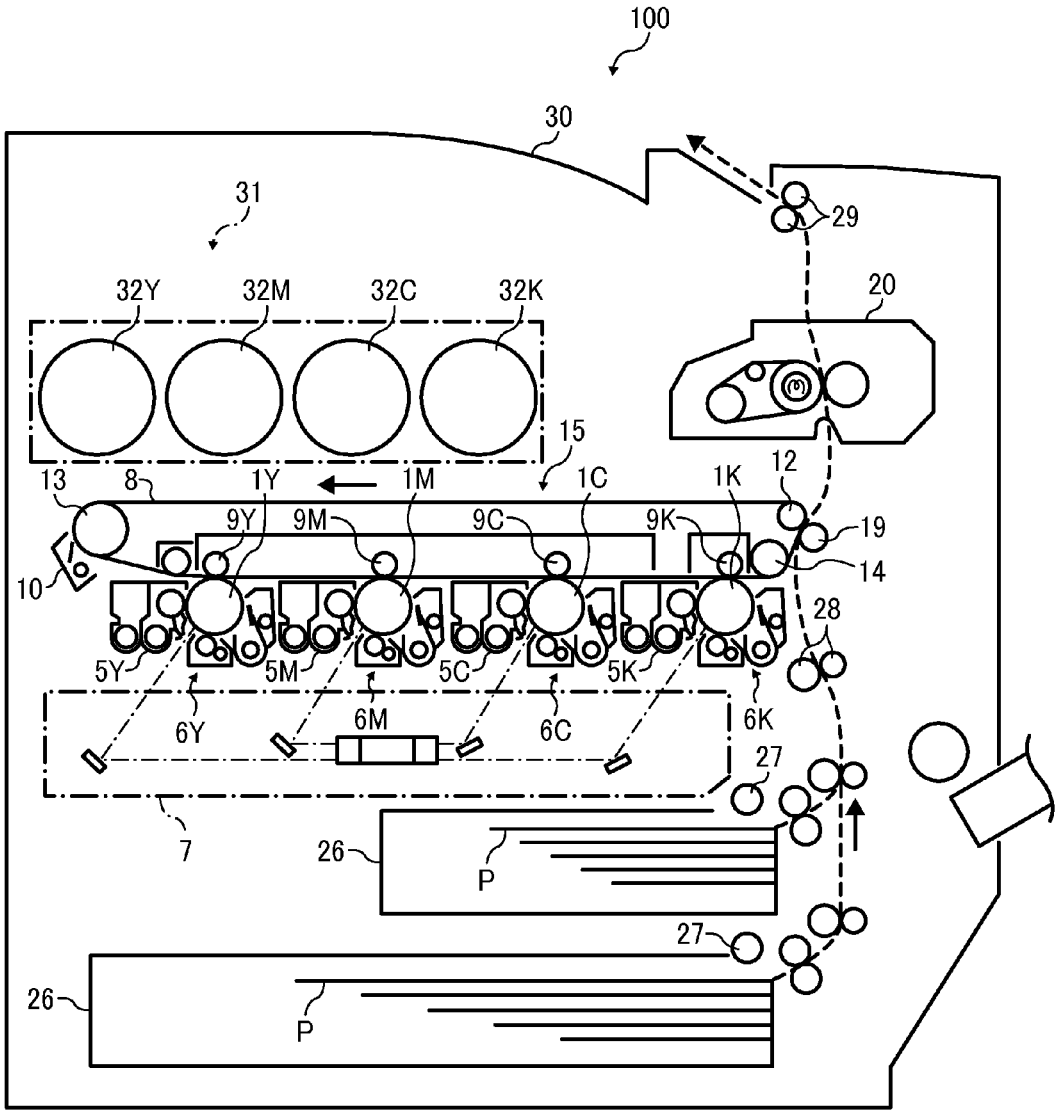
FIG. 1 is a schematic diagram of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

An aim of the embodiment described below is to loosen coagulation upstream from a position where developer is received in a developer compartment on the side of a developer bearer (i.e., a developer compartment to supply developer to the developer bearer), thereby inhibiting image failure resulting from the coagulation. It is to be noted that the terms "coagulation" and "aggregates" used here mean those included in supplied toner or created inside a developing device, and the terms "loose coagulation" and "loosely coagulated developer (or toner)" used herein mean coagulation or aggregates that can be loosened relatively easily.

Image failure may in inhibited, for example, by using moisture-proof packaging materials or ball bearings having good slidability, increasing image output intervals, or rotating the developer bearer in reverse. These approaches, however, can increase the cost and usability restrictions. In the approach using a temperature detector and increasing image output intervals according to the detected temperature, the component number increases and control is more complicated. In the case of rotating the developer bearer in reverse, the control processes include forming a continuous pattern latent image on the image bearer, detecting fluctuations in contrast of the developed pattern, and rotating the developer bearer in reverse according to the detection results. Thus, the control is more complicated.

By contrast, when coagulation or loosely coagulated developer is loosened inside the developing device, such disadvantages can be eliminated.

Meanwhile, the loosely coagulated developer may be broken upstream from the developer regulator (i.e., on the backside of a developer regulator or doctor blade) inside the developing device. In this case, however, the force to loosen the coagulation acts in the entire longitudinal range of the developer bearer, and the stress on developer may be excessive. Loosening coagulation using a filter can increase the stress on developer as well. Since the stress on developer degrades toner and carrier, it is preferred to reduce the stress on developer to inhibit degradation of toner and carrier included in developer. Thus, there is trade-off between reduction in stress and loosening the coagulation.

In the first embodiment, multiple openings together form a communicating portion through which developer is received in a first developer compartment (on the side of the developer bearer) from a second developer compartment to send developer to the first developer compartment.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram of an image forming apparatus 100 according to the present embodiment.

In the configuration shown in FIG. 1, a toner replenishing device 31 serving as a replenishing device is provided above an apparatus body of the image forming apparatus 100, which can be a printer, for example. In the toner replenishing device 31, four toner cartridges 32Y, 32M, 32C, and 32K, serving as powder containers, corresponding to yellow (Y), magenta (M), cyan (C), and (K), are mounted removably and replaceably.

Other portions of the toner replenishing device 31 than the toner cartridges 32 includes toner conveyance devices, serving as powder conveyance devices, to transport toner (i.e., image forming powder) to respective destinations, that is, developing devices 5 described later. An intermediate transfer unit 15 is provided beneath the toner replenishing device 31. Image forming units 6Y, 6M, 6C, and 6K are disposed facing an intermediate transfer belt 8 in the intermediate transfer unit 15 and arranged in that order in the direction of rotation of the intermediate transfer belt 8.

Figure 2:
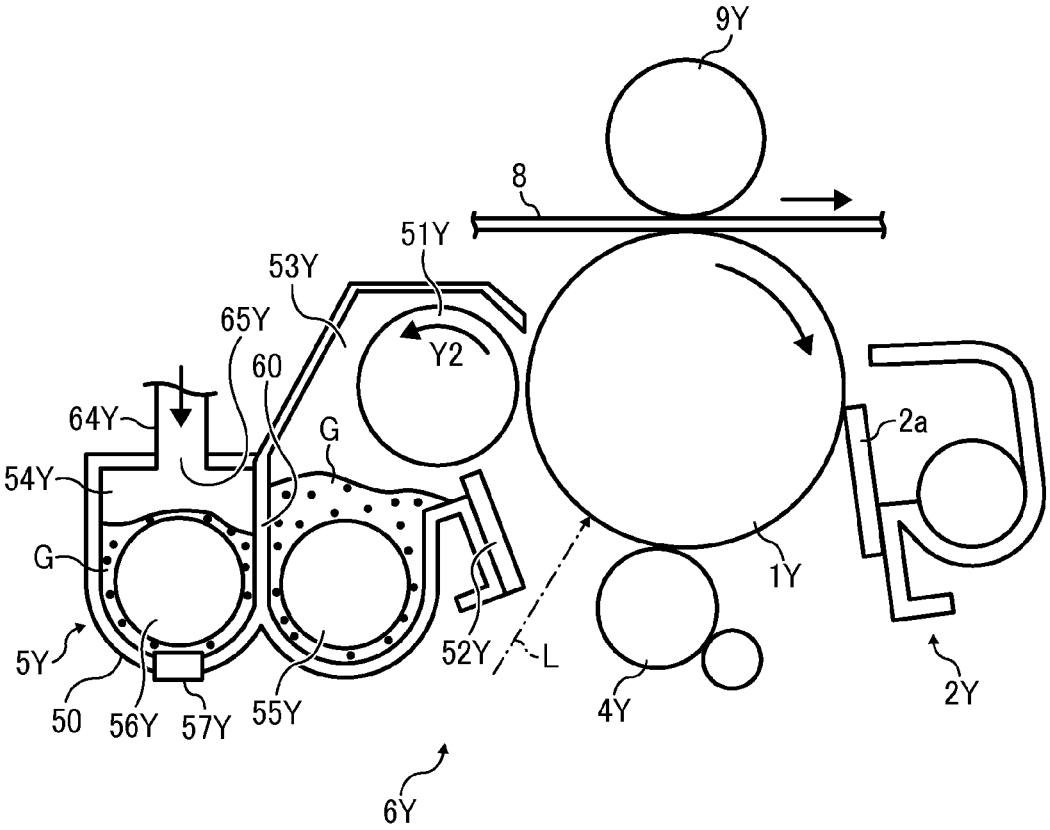
FIG. 2 is a schematic diagram illustrating a configuration of an image forming unit included in the image forming apparatus shown in FIG. 1.

FIG. 2 is an enlarged view of the image forming unit 6Y.

Referring to FIG. 2, the image forming unit 6Y for yellow includes a photoreceptor drum 1Y and further includes a charging member 4Y, the developing device 5Y, a cleaning unit 2Y, a discharger, and the like provided around the photoreceptor drum 1Y. Image forming processes, namely, charging, exposure, development, transfer, and cleaning processes are performed on the photoreceptor drum 1Y, and thus a yellow toner image is formed on the photoreceptor drum 1Y.

The image forming unit 6Y can be configured as a process cartridge in which the photoreceptor drum 1Y, the charging member 4Y, the developing device 5Y, and the cleaning unit 2Y are united into a modular unit. Alternatively, the respective components may be independent units to be removably installed in the apparatus body independently. For example, the developing device 5Y may be designed as an independent unit removably installed in the apparatus body. Yet alternatively, the developing device 5Y and at least one of the photoreceptor drum 1Y, the charging member 4Y, and the cleaning unit 2Y may be united together as a modular unit removably installed in the apparatus body.

It is to be noted that other image forming units 6 have a similar configuration to that of the yellow image forming unit 6Y except the color of toner used therein and form toner images of the respective colors.

Thus, the image forming unit 6Y is described below as a representative and descriptions of other image forming units 6 are omitted.

Referring to FIG. 2, the photoreceptor drum 1Y is rotated clockwise as indicated by arrow shown in FIG. 2 by a driving motor. The surface of the photoreceptor drum 1Y is charged uniformly at a position facing the charging member 4Y by the charging member 4Y (charging process). When the photoreceptor drum 1Y reaches a position to receive a laser beam L emitted from an exposure device 7 (shown in FIG. 1), the photoreceptor drum 1Y is scanned with the laser beam L, and thus an electrostatic latent image for yellow is formed thereon (exposure process).

The developing device 5Y develops the electrostatic latent image on the photoreceptor drum 1Y into a yellow toner image (i.e., developing process). The yellow toner image is primarily transferred from the photoreceptor drum 1Y onto the intermediate transfer belt 8 (i.e., primary-transfer process).

When the surface of the photoreceptor drum 1Y reaches a position facing the cleaning unit 2Y, a cleaning blade 2*a* of the cleaning unit 2Y mechanically collects toner remaining on the photoreceptor drum 1Y (cleaning process).

Subsequently, the discharger removes potentials remaining on the surface of the photoreceptor drum 1Y.

Thus, a sequence of image forming processes performed on the photoreceptor drum 1Y is completed.

The above-described image forming processes are performed in the image forming units 6M, 6C, and 6K similarly to the yellow image forming unit 6Y. That is, the exposure device 7 disposed beneath the image forming units 6 in FIG. 1 directs laser beams L according to image data onto the photoreceptor drums 1 in the respective image forming units 6. Specifically, the exposure device 7 includes light sources to emit the laser beams L, multiple optical elements, and a polygon mirror that is rotated by a motor. The exposure device 7 directs the laser beams L to the respective photoreceptor drums 1 via the multiple optical elements while deflecting the laser beams L with the polygon mirror.

Then, the toner images formed on the respective photoreceptor drums 1 through the development process are transferred therefrom and superimposed one on another on the intermediate transfer belt 8. Thus, a multicolor toner image is formed on the intermediate transfer belt 8.

Referring now to FIG. 1, the intermediate transfer unit 15 includes the intermediate transfer belt 8, four primary-transfer bias rollers 9, a secondary-transfer backup roller 12, a cleaning backup roller 13, a tension roller 14, an intermediate-transfer cleaning unit 10, and the like. The intermediate transfer belt 8 is supported by the above-described rollers 12, 13, and 14 and is rotated in the direction indicated by an arrow shown in FIG. 1 as the secondary-transfer backup roller 12 rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are hereinafter referred to as primary-transfer nips. Each primary-transfer bias roller 9 receives a transfer bias whose polarity is opposite the charge polarity of toner. While rotating in the direction indicated by the arrow shown in FIG. 1, the intermediate transfer belt 8 sequentially passes through the respective primary-transfer nips. Then, the single-color toner images are transferred from the respective photoreceptor drums 1 primarily and superimposed one on another on the intermediate transfer belt 8, forming a multicolor image.

Then, the intermediate transfer belt 8 carrying the multicolor toner image reaches a position facing the secondary-transfer roller 19 disposed facing the secondary-transfer backup roller 12. The secondary-transfer backup roller 12 and the secondary-transfer roller 19 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the intermediate-transfer cleaning unit 10, toner remaining on the intermediate transfer belt 8 is collected by the intermediate-transfer cleaning unit 10. Thus, a sequence of image forming processes performed on the intermediate transfer belt 8 is completed.

The sheet P is transported by a sheet feeder 26 provided in the lower portion of the apparatus body to the secondary-transfer nip via a feed roller 27, pairs of conveyance rollers, and a pair of registration rollers 28. More specifically, the sheet feeder 26 contains multiple sheets P piled one on another. The feed roller 27 rotates counterclockwise in FIG. 1 to feed the sheet P on the top toward a nip formed between the registration rollers 28.

When a leading edge of the sheet P reaches the nip therebetween, the registration rollers 28 suspend rotation, stopping the sheet P. The registration rollers 28 resume rotating to transport the sheet P to the secondary-transfer nip, time to coincide with the arrival of the multicolor toner image formed on the intermediate transfer belt 8. In the secondary-transfer nip, the multicolor toner image is transferred from the intermediate transfer belt 8 onto the sheet P (secondary-transfer process).

Subsequently, the sheet P onto which the multicolor image is transferred is transported to a fixing device 20. In the fixing device 20, the multicolor toner image is fixed on the sheet P with heat from a fixing roller and pressure exerted by a pressure roller. Then, the sheet P is discharged through a nip between discharge rollers 29 outside the apparatus and stacked on a stack tray 30 as an output image.

Thus, a sequence of image forming processes is completed.

[First Embodiment]

Next, a configuration and operation of the developing device 5Y according to a first embodiment is described in further detail below. In the descriptions below, the subscript "Y" attached to the components of the developing device 5Y may be omitted.

The developing device 5Y includes a developing roller 51Y, a doctor blade 52Y, a developer chamber 50 including first and second developer compartments 53Y and 54Y, first and second conveying screws 55Y and 56Y, and a density sensor 57Y. The developing device 5Y according to the present embodiment is a biaxial circulation-type developing device and also called a horizontal biaxial circulation-type developing device since the two axes are arranged horizontally.

The developing roller 51Y faces the photoreceptor drum 1Y, and the doctor blade 52Y faces the developing roller 51Y. The first and second conveying screws 55Y and 56Y are respectively disposed in the first and second developer compartments 53Y and 54Y partitioned by a partition 60. The density sensor 57Y detects the density of toner, for example, the concentration of toner in developer in the second developer compartment 54Y provided with the second conveying screw 56Y.

The developing roller 51Y includes a stationary magnet or stationary multiple magnets and a sleeve that rotates around the stationary magnet. Two-component developer consisting essentially of carrier (carrier particles) and toner (toner particles) is contained in the first and second developer compartments 53Y and 54Y. The second developer compartment 54Y communicates with a toner conveying pipe 64Y that forms a powder conveyance channel through an opening formed in an upper portion of the second developer compartment 54Y.

Operation of the developing device 5Y is described below.

The sleeve of the developing roller 51Y rotates in the direction indicated by arrow Y2 shown in FIG. 2. The developer held on the developing roller 51Y by the magnetic field generated by the magnets is transported as the sleeve rotates.

The ratio of toner to carrier (the concentration of toner) in developer contained in the developing device 5Y is adjusted within a predetermined range. More specifically, according to the consumption of toner in the developing device 5Y, the toner replenishing device 31 supplies toner from the toner cartridge 32Y via a toner supply channel and the toner conveying pipe 64Y to the second developer compartment 54Y from a toner supply inlet 65Y.

Then, the supplied toner is mixed with developer by the second conveying screw 56Y and further by the first conveying screw 55Y and circulated in the first and second developer compartments 53Y and 54Y in the direction perpendicular to the surface of the paper on which FIG. 2 is drawn. Then, toner is electrically charged through friction with carrier, adsorbed to the carrier, and carried on the developing roller 51Y together with the carrier.

The developer carried on the developing roller 51Y is transported in the direction indicated by arrow Y2 in FIG. 2 to the doctor blade 52Y. The amount of developer on the developing roller 51Y is adjusted to a suitable amount by the doctor blade 52Y, after which developer is transported to the development range facing the photoreceptor drum 1Y. Then, the toner in developer adheres to the latent image formed on the photoreceptor drum 1Y due to the effect of the magnetic field generated in the development range. Subsequently, as the sleeve rotates, the developer remaining on the developing roller 51Y reaches an upper portion of the first developer compartment 53Y and leaves the developing roller 51Y.

Figure 3A:
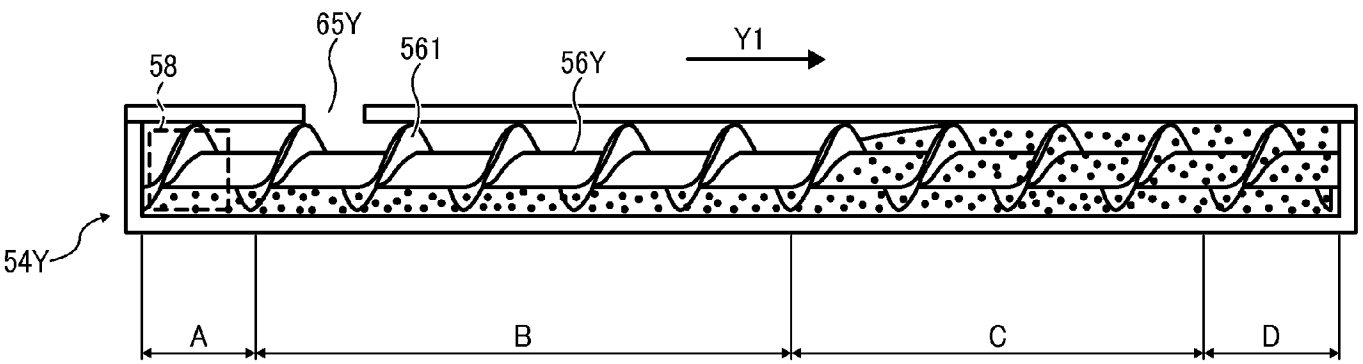
FIG. 3A is a cross-sectional view illustrating an interior of a second developer compartment along a longitudinal direction of a developing device according to an embodiment.
Figure 3B:
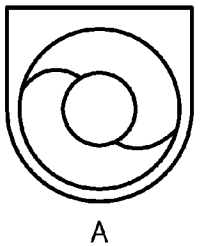
FIGS. 3B through 3E are cross-sectional views perpendicular to the cross section shown in FIG. 3A and illustrate an interior of the second developer compartment.
Figure 3C:
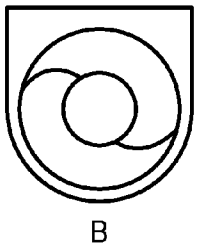

FIG. 3A is a vertical cross-sectional view that illustrates an interior of the second developer compartment 54Y along the axis of the second conveying screw 56Y. FIGS. 3B through 3E are cross-sectional views perpendicular to the cross section shown in FIG. 3A and illustrate cross sections in ranges A through D shown in FIG. 3A, respectively.

In FIG. 3A, arrow Y1 indicates the direction in which developer is transported (hereinafter "developer conveyance direction) in the second developer compartment 54Y. In the range A corresponding to FIG. 3B, an opening 58 serving as a first communicating portion (i.e., developer returning opening) is formed for developer to return from the first developer compartment 53Y to the second developer compartment 54Y. The first developer compartment 53Y is for agitating and supplying developer to the developing roller 51Y and thus serves as a supply-side developer compartment. The second developer compartment 54Y is for agitating and transporting developer to the first developer compartment 53Y and thus serves as a replenishment-side developer compartment.

The toner supply inlet 65Y is positioned midway in the range B, and toner supplied from the toner cartridge 32Y via the toner conveying pipe 64Y enters the range B through the toner supply inlet 65Y. Accordingly, the range B has a capability of dispersing toner in developer uniformly.

Figure 3D:
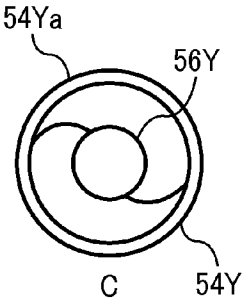
Figure 3E:
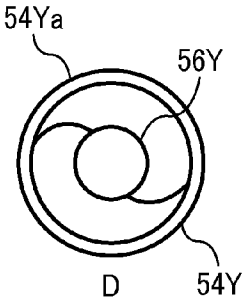

In the range C, a ceiling portion 54Ya of a wall forming the second developer compartment 54Y is circular conforming to the outer circumference of the second conveying screw 56Y as shown in FIG. 3D.

The ceiling portion 54Ya in the range D is similar to that in the range C. Further, a communicating portion 59 (shown in FIG. 4, serving as a second communicating portion) is formed in the partition 60 in the range D to send developer from the second developer compartment 54Y to the first developer compartment 53Y. In the ranges C and D, a clearance of about 1.5 mm is secured between the screw blade 561 of the second conveying screw 56Y and the wall face of the second developer compartment 54Y. The ranges C and D together occupy about 60% of the second developer compartment 54Y in the longitudinal length.

Figure 4:
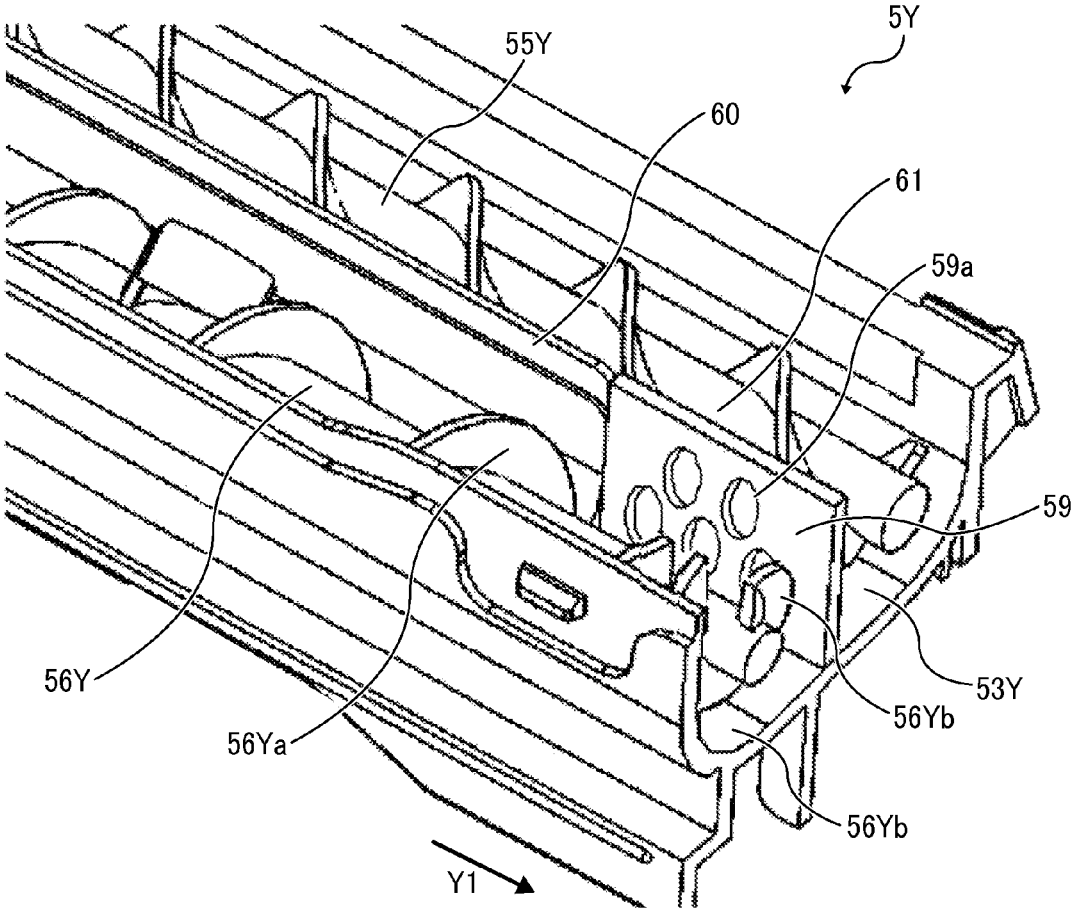
FIG. 4 is a perspective view illustrating a first developer compartment, the second developer compartment, and a communicating portion therebetween according to a first embodiment.

FIG. 4 is a perspective view illustrating relations among the first and second developer compartments 53Y and 54Y and the communicating portion 59. FIGS. 5A through 5F illustrate configurations of the communicating portion 59.

It is to be noted that FIG. 4 is a perspective view illustrating the developing device 5Y from which an upper case (i.e., a lid) is removed. Although the upper portions of the first and second developer compartments 53Y and 54Y do not to conform to the screw shape in FIG. 4, when the upper case is attached to the developing device 5Y, the first and second developer compartments 53Y and 54Y have the cross-sectional shapes shown in FIGS. 3B through 3E. With this configuration, developer can be inhibited from flowing from the second developer compartment 54Y to the first developer compartment 53Y in areas other than the communicating portion 59.

It is to be noted that the communicating portion 59 shown in FIGS. 5A through 5F are respectively constructed of multiple through holes 59*a*1 through 59*a*6, which are collectively referred to as "through holes 59*a*".

The communicating portion 59 in the present embodiment is constructed of multiple openings. For example, in the configuration shown in FIGS. 4 through 5F, the communicating portion 59 is formed by a plate in which multiple through holes 59*a* are formed, and the plate is fitted in a cutout 61 formed in the partition 60. The communicating portion 59 is designed to move developer from the second developer compartment 54Y to the first developer compartment 53Y through the multiple through holes 59*a*.

Figure 5A:
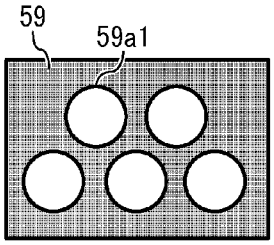
FIGS. 5A through 5F illustrate configurations of the communicating portion shown in FIG. 4.

In the configuration shown in FIGS. 4 and 5A, five through holes 59*a*1 each having a diameter of 5 mm are arranged in two rows, two in the upper row and three in the lower row. The area (i.e., opening area) of the through holes 59*a*1 in total is 98 $mm^2$, for example. The distance between the centers of adjacent through holes 59*a*1 is 6.5 mm, for example.

When the opening area of the through holes 59*a* is smaller, the through holes 59*a* can exert the capability to dissolve coagulation of developer since developer can be compacted in front of the through holes 59*a*. However, the flow amount per unit time of developer flowing from the second developer compartment 54Y to the first developer compartment 53Y is determined by the image forming process linear velocity and the bulk of developer to be kept in the first developer compartment 53Y. Therefore, a suitable range of the opening area to secure the flow amount of developer is determined depending on the combination with the conveyance capability of the second conveying screw 56Y in the second developer compartment 54Y.

It is to be noted that, in the present embodiment, the screw pitch of the first conveying screw 55Y is about 40 mm in an upstream portion and about 20 mm in a downstream portion in the developer conveyance direction by the first conveying screw 55Y. The first conveying screw 55Y is not limited to the above-described dimensions but can be otherwise to attain developer balance with which developer can be compacted upstream from of the communicating portion 59.

With this configuration, the bulk (i.e., level) of developer in the second developer compartment 54Y can be as shown in FIG. 3A. That is, the level of developer is lower at a position where toner is supplied, and, in a downstream area, developer is packed to the ceiling portion 54Ya conforming to the shape of the first conveying screw 55Y. In particular, developer is compacted extreme downstream in the second developer compartment 54Y. If the ceiling portion 54Ya of the second developer compartment 54Y does not conform to the screw shape, (that is, clearance is larger as in the range B shown in FIG. 3C), rotation of the second conveying screw 56Y is not transmitted to an outer area in the cross section perpendicular to the axial direction, and thus an immobile layer of developer is created. By contrast, since the second developer compartment 54Y has a circular cross section following the screw shape, such an immobile layer is not created and developer can be transported smoothly.

In the present embodiment, coagulated developer (i.e., loose coagulation) is loosened by the through holes 59*a*. Effects of the present embodiment to loosen coagulated developer were examined as follows. In the examination, an amount of developer coagulation greater than the amount created in practice was put in the toner supply inlet 65Y. The developer coagulation was created as follows.

1. In a Hitachi centrifugal machine Himac CP100MX, 0.5 g per cell of polymerized toner having a particle size of 5.2 nm was put. The toner was subjected to centrifugal pressure under the conditions of a frequency of centrifugal rotation of 12000 revolutions per minute (rpm), a centrifugal time of 5 minutes, and a temperature of 23° C.

2. Subsequently, toner in the cell was sieved using a sieve having a mesh opening of 106 μm. Developer coagulation remaining in the sieve was put in the toner supply inlet 65 of the developing device 5.

It is to be noted that the inventors of the present invention have found the above-described conditions seeking conditions to attain a similar level of image failure, namely, spots, white lines, and shooting star marks, to that caused by developer coagulation arising in the toner bottle (toner cartridge) or the toner replenishing device 31.

The coagulation thus created was put in the toner supply inlet 65Y of the developing device 5Y, solid images were output on 20 sheets of A3 paper, and the number of spots and shooting star marks were evaluated.

According to the evaluation results, the number of spot and shooting star marks is 50% or smaller in the developing device 5Y including the through holes 59*a* compared with a comparative developing device in which the communicating portion 59 is not constructed of multiple holes but a single opening extending from the bottom to the ceiling over a length of 25 mm from the downstream end of the second developer compartment 54Y. The opening area is 350 $mm^2$ in the comparative developing device.

Figure 6:
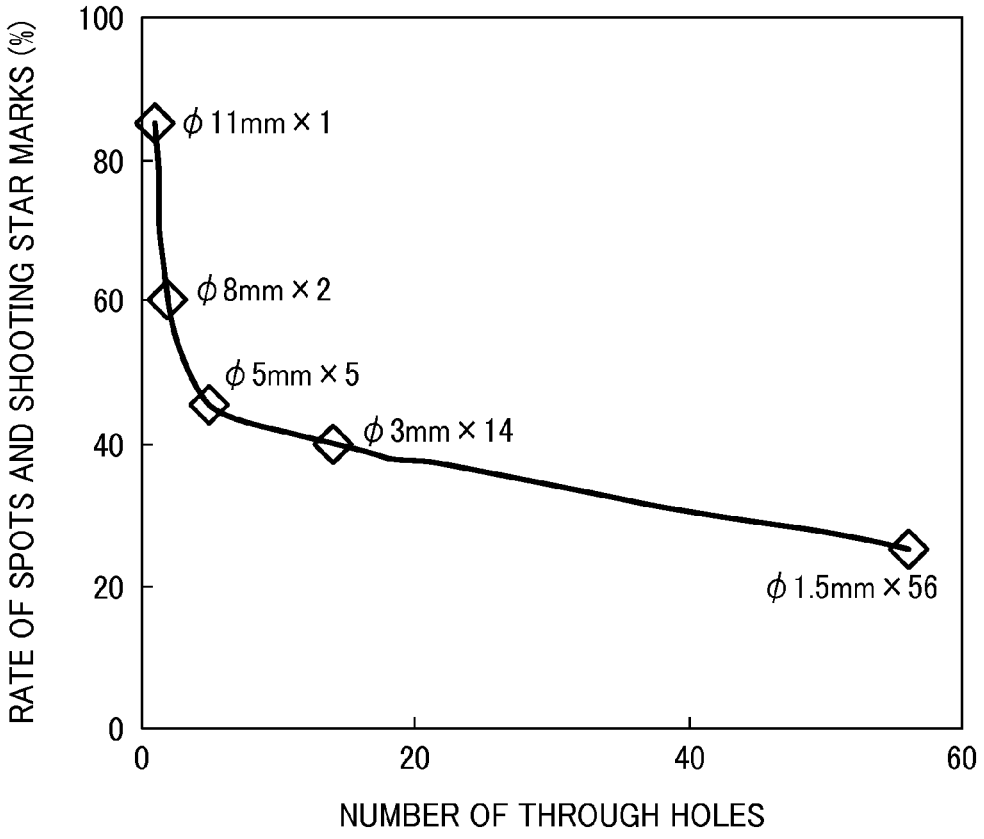
FIG. 6 is a graph illustrating the number of spots and shooting star marks in images in configurations in which the area of through holes in total is identical but the number thereof and size of each through hole are different.

FIG. 6 is a graph illustrating changes in number of spots and shooting star marks arising in configurations in which the total opening area of the communicating portion 59 is identical but the number (and size of each) of the circular through holes 59*a* are different.

In FIG. 6, the axis of ordinates represents the rate in number of spots and shooting star marks. In other words, FIG. 6 illustrates changes in the number of spots and shooting star marks when the size of each through hole 59*a* is varied while keeping the total opening area of the through holes 59*a* identical to that of the configuration shown in FIG. 5A.

According to FIG. 6, in the case of the communicating portion 59 constructed of a single circular through hole having a diameter (ϕ) of 11 mm (11 mm×1) and having an opening area of 98 $mm^2$ similarly to the configuration shown in FIGS. 4 and 5A, the number of spots and shooting star marks is 85% of that in the comparative developing device having an opening area of 350 $mm^2$. Although the image quality improved, the improvement is smaller when the number of the holes is one.

Changes in the number of spots and shooting star marks were further examined when the diameter (ϕ) of the circular through holes were varied to 8 mm, 5 mm, 3 mm, and 1.5 mm and the number of the through holes were varied to 2, 5, 15, and 56 while the total opening area is kept constant.

Figure 5B:
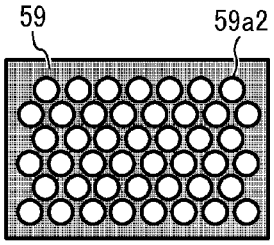

FIG. 5B illustrates a configuration of the communicating portion 59 in which each through hole 59*a*2 has a diameter (ϕ) of 1.5 mm and the through holes 59*a*2 are arranged in a grid pattern of 60°.

From FIG. 6, it can be known that the number of spots and shooting star marks resulting from coagulation decreases as the number of the through holes 59*a* increases. In particular, improvement is greater when the diameter of the through holes 59*a* is 5 mm or smaller.

The coagulation can be loosened better when the number of the multiple through holes 59*a* forming the communicating portion 59 is greater because differences in velocity are generated between developer passing adjacent the circumference of the through hole 59*a* and developer passing through a middle portion of the through hole 59*a*, and shearing force acts on the coagulation. Additionally, particles positioned between the adjacent through holes 59*a* are blocked by the wall and prevented from moving to the first developer compartment 53Y. Accordingly, developer moves inside the second developer compartment 54Y in the axial direction or the direction of rotation of the second conveying screw 56Y. At that time, strong force can acts on the coagulation, breaking the coagulation.

It is to be noted that the developing device used in the evaluation is a modification of a developing device for A3 size apparatus having a capability of 50 copies per minute (CPM), the amount of developer is 220 g with a toner concentration of 7 weight percent (wt %), and the outer diameter of the screw is 14 mm. When the opening area of the communicating portion 59 is 150 $mm^2$ or greater in the developing device 5Y of this size, developer is not compacted in the second developer compartment 54Y, and there are little effects of reducing the number of spots and shooting star marks.

Figure 5C:
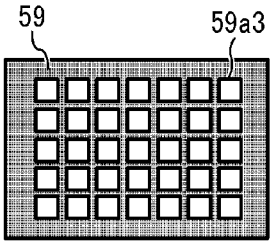
Figure 5D:
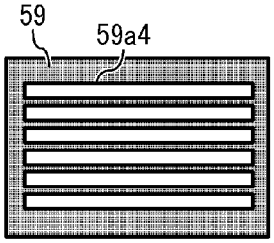
Figure 5E:
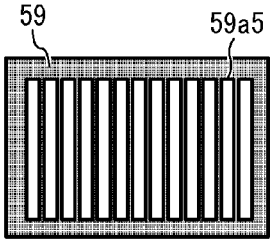
Figure 5F:
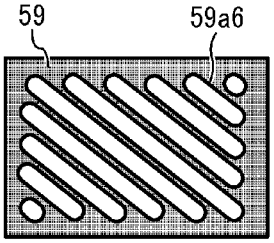

Additionally, examples of the through holes 59*a* include the circular through holes 59*a*1 and 59*a*2 shown in FIGS. 5A and 5B, the square through holes 59*a*3 shown in FIG. 5C, the slot-like through holes 59*a*4 and 59*a*5, shown in FIGS. 5D and 5E, that are rectangular, and the oval through holes 59*a*6, shown in FIG. 5F, having circular ends and arranged obliquely (for example, at an angle of 45 degrees).

More specifically, FIG. 5C illustrates a configuration in which the square through holes 59*a*3 having a lateral length of 1.5 mm and a height of 1.5 mm are arranged at equal intervals of 2.5 mm between the centers of the adjacent square through holes 59*a*3. FIG. 5D illustrates a configuration in which each slot-like through hole 59*a*4 is a lateral rectangle having a height of 1 mm and a lateral length of 20 mm. FIG. 5E illustrates a configuration in which each slot-like through hole 59*a*5 is a vertical rectangle having a height of 12 mm and a lateral length of 1 mm. FIG. 5F illustrates a configuration in which each oval through hole 59*a*6 is oriented obliquely (for example, at an angle of 45 degrees) to the axial direction, and the oval through hole 59*a*6 has a short-side length of 1.5 mm.

In each of the above-described configurations, by providing the multiple through holes 59*a* and having a shorter side length of 5 mm or shorter, differences in velocity can be generated between developer passing adjacent the circumference of the through hole 59*a* and developer passing through the middle of the through hole 59*a*, and shearing force to loosen the coagulation can act on the coagulation. As a result, in each case, image quality can be improved with the number of spots and shooting star marks reduced.

As described above, the following effects can be attained by the respective aspects of the present specification.

Aspect 1: A developing device includes a first developer compartment from which developer is supplied to a developer bearer, such as the developing roller 51Y, a second developer compartment to agitate and send developer to the first developer compartment, and first and second communicating portions, such as the opening 58 and the communicating portion 59, through which developer is circulated between the two developer compartments. The second communicating portion is to send developer from the second developer compartment to the first developer compartment and is constructed of multiple through holes, such as the through holes 59*a* (59*a*1 through 59*a*6).

This configuration can generate differences in velocity between developer passing adjacent the circumference of the through hole and developer passing through a middle portion of the through hole, and shearing force acts on coagulated developer, loosening the coagulation.

Since the second communicating portion includes walls positioned between the through holes to block developer, developer is blocked from moving to the first developer compartment and transported inside the second developer compartment in the axial direction or the direction of rotation of a second developer conveyor in the second developer compartment. At that time, the coagulation receives strong force and is broken.

As a result, coagulation in supplied toner or created inside the developing device can be loosened upstream from the communicating portion where developer is received in the first developer compartment on the side of the developer bearer, thereby inhibiting image failure resulting from the coagulation.

Aspect 2: each of the through holes can be either circular, square, rectangular, or oval.

Aspect 3: The long, rectangular through holes are oriented either parallel, perpendicular, or oblique to the longitudinal direction of the first and second developer compartments (i.e., axial direction of the developer conveyors therein). Regardless of the shape and orientation of the through holes, the above-described effect can be attained.

Aspect 4: Since the multiple through holes are arranged at equal intervals, the amount of developer transported from the second developer compartment to the first developer compartment can be uniform over the entire area of the second communicating portion.

Aspect 5: Differences in velocity can be generated among the three types of developer respectively passing through a portion where the through hole is not present, developer passing through an end portion of the through hole, and developer passing through the middle portion of the through hole. Since the through hole has a short side length of 5 mm or smaller, the difference in velocity can be generated in greater number of areas. As a result, the shearing force to broken the coagulation can act at each of such areas, thus loosening the coagulation more efficiently.

Aspect 6: A replenishing device, such as the toner replenishing device 31, to supply developer or toner to the first developer compartment is provided. Accordingly, in addition to coagulation generated in the developing device, coagulation included in the supplied developer (i.e., supplied toner) can be loosened upstream from the communicating portion where developer is received in the first developer compartment to supply developer to the developer bearer without applying excessive stress to the developer.

[Second Embodiment]

A second embodiment is described below. The developing device according to the second embodiment is similar to that in the first embodiment other than the differences described below.

Figure 7:
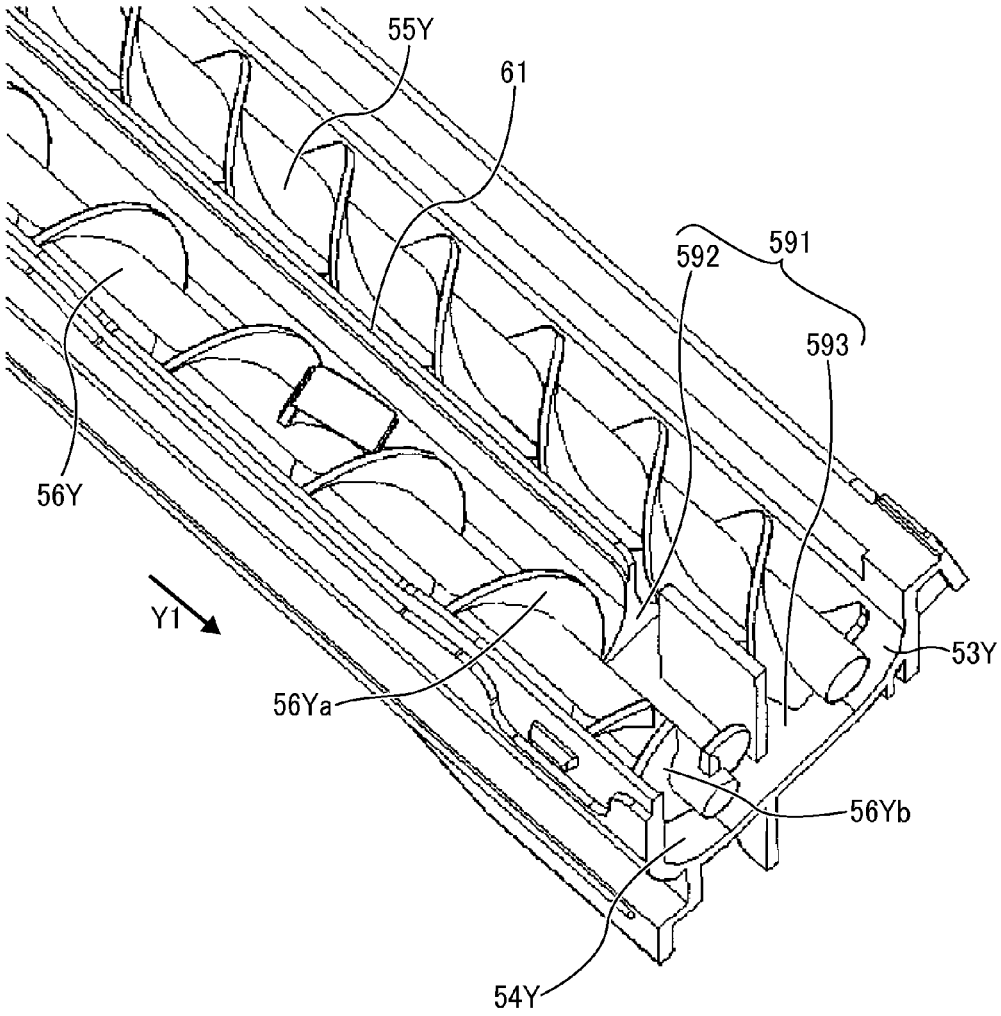
FIG. 7 is a perspective view illustrating relations among the first and second developer compartments and a communicating portion therebetween according to a second embodiment.
Figure 8B:
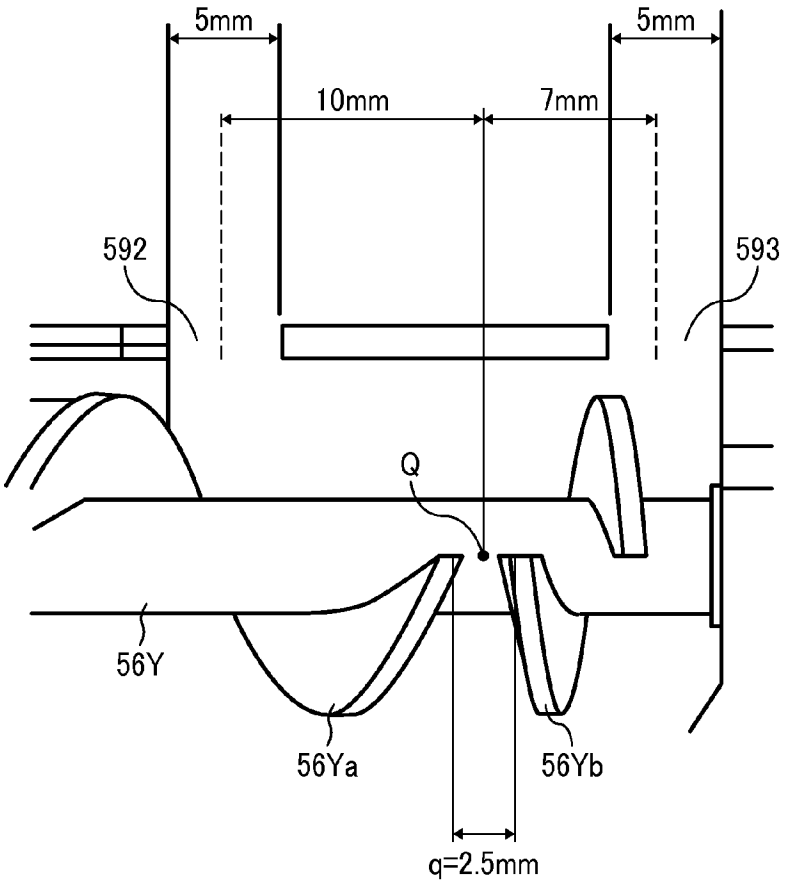
FIGS. 8A and 8B illustrate configurations of the communicating portion shown in FIG. 7.
Figure 8A:
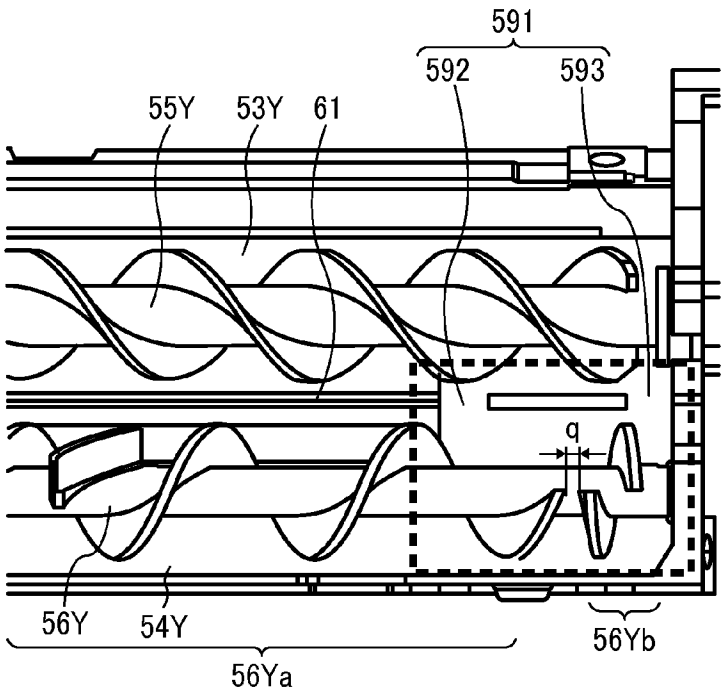

FIG. 7 is a perspective view illustrating relations among the first and second developer compartments 53Y and 54Y and a communicating portion 591 serving as the second communicating portion according to the second embodiment. FIGS. 8A and 8B illustrate configurations of the communicating portion 591 in further detail.

It is to be noted that, in FIG. 7, the upper case (i.e., a lid) is removed from the developing device 5Y. Although the upper portions of the first and second developer compartments 53Y and 54Y do not to conform to the screw shape in FIG. 7, the first and second developer compartments 53Y and 54Y have the cross-sectional shapes shown in FIGS. 3B through 3E when the upper case is attached to the developing device 5Y. With this configuration, developer can be inhibited from flowing from the second developer compartment 54Y to the first developer compartment 53Y in areas other than the communicating portion 591.

As shown in FIG. 7, in the present embodiment, the second conveying screw 56Y includes a normal winding portion 56Ya and a reversed winding portion 56Yb, between which a clearance q is secured.

The communicating portion 591 according to the present embodiment is constructed of multiple openings. In the configuration shown in FIG. 7, the communicating portion 591 includes two openings, namely, first and second portions 592 and 593. For example, the first and second portions 592 and 593 each have an area of about 87 $mm^2$ (with a vertical length of 17.41 mm and a width of 5 mm) The first and second portions 592 and 593 and the clearance q have the following relation.

Referring to FIG. 8B, a center of the first portion 592 is shifted 10 mm upstream from a midpoint Q of the clearance q in the developer conveyance direction Y1 in the second developer compartment 54Y in the longitudinal direction of the developing device 5Y (i.e., axial direction). A center of the second portion 593 is shifted 7 mm downstream from the midpoint Q of the clearance q in the developer conveyance direction Y1 in the second developer compartment 54Y in the longitudinal direction.

For example, the second conveying screw 56Y has an outer diameter of 14 mm. Further, the pitch of the normal winding portion 56Ya is 15 mm on the upstream side and 20 mm on the downstream side, the pitch of the reversed winding portion 56Yb is 5 mm, and the clearance q is 2 mm, for example.

With this configuration, as shown in FIG. 3A, the bulk (i.e., level) of developer in the second developer compartment 54Y can be lower on the side of the opening 58 to return developer from the first developer compartment 53Y to the second developer compartment 54Y. On the downstream side (on the side of the communicating portion 591), developer is packed to the ceiling portion 54Ya conforming to the shape of the second conveying screw 56Y. In particular, developer is compacted extreme downstream in the second developer compartment 54Y.

FIGS. 9A through 9D illustrate a downstream portion of the second developer compartment 54Y as viewed from the side of the first developer compartment 53Y for understanding of relative positions of the communicating portion 591 and the second conveying screw 56Y. It is to be noted that, in FIGS. 9A to 9D, the partition 60 between the first and second developer compartments 53Y and 54Y is omitted to illustrate rotation of the second conveying screw 56Y.

Figure 9A:
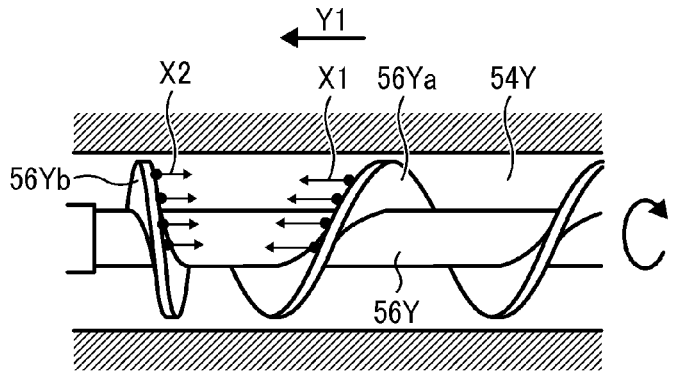
FIGS. 9A through 9D illustrate a downstream portion of the second developer compartment as viewed from the side of the first developer compartment for understanding of relative positions of the communicating portion and the second conveying screw according to the second embodiment.
Figure 9B:
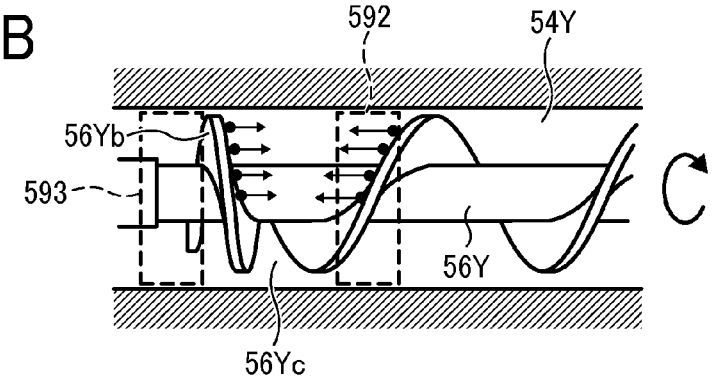
Figure 9C:
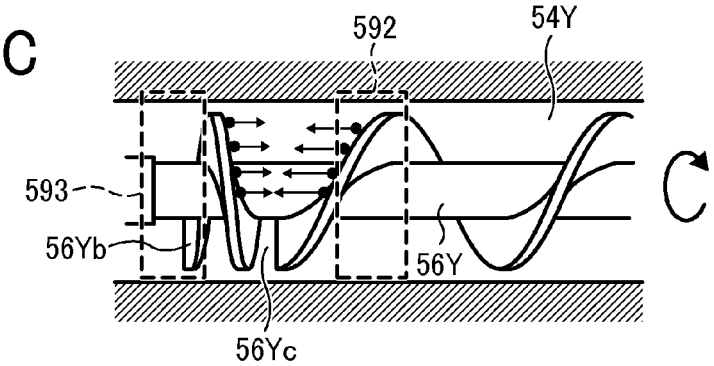
Figure 9D:
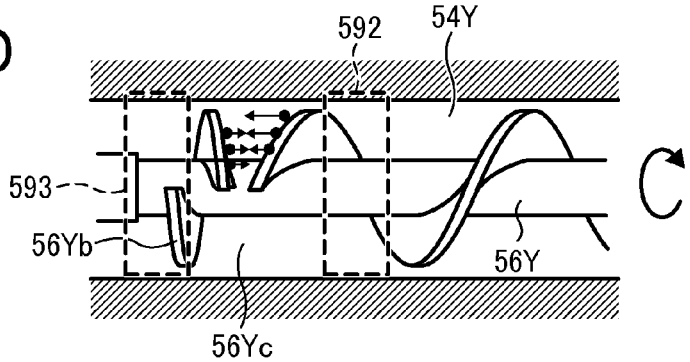

In the second developer compartment 54Y, the normal winding portion 56Ya of the second conveying screw 56Y transports developer to the left in FIG. 9A as indicated by arrows X1, By contrast, referring to FIGS. 9A to 9C, adjacent to the downstream end in the developer conveyance direction Y1, the reversed winding portion 56Yb of the second conveying screw 56Y transports developer away from the downstream end, that is, to the right as indicated by arrow X2 in FIG. 9A. As a result, in a boundary range 56Yc between the normal winding portion 56Ya and the reversed winding portion 56Yb, developer transported by the normal winding portion 56Ya collides and rubs against (i.e., slidingly contacts) developer transported by the reversed winding portion 56Yb. The sliding force at that time can break toner aggregates included in developer.

Regarding the second developer compartment 54Y, in an area adjacent to the midpoint Q of the clearance q, the stress on developer tends to be more than the degree required to break the aggregates due to the collision between developer transported by the normal winding portion 56Ya and developer transported by the reversed winding portion 56Yb.

As described above, the first portion 592 is positioned 10 mm upstream from the midpoint Q and the second portion 593 is positioned 7 mm downstream from the midpoint Q. With this arrangement, initially a majority of developer is sent to the first developer compartment 53Y through the first portion 592 and does not reach the adjacent area of the midpoint Q (see FIGS. 9B and 9C.). Consequently, the stress on developer at that position can be alleviated. Further, developer in the area adjacent to the reversed winding portion 56Yb is made less compacted by the second portion 593. Consequently, the stress on developer generated adjacent to the midpoint Q can be alleviated. Thus, in the present embodiment, stress on developer can be alleviated while the capability to break toner aggregates is secured.

It is to be noted that, to generate force required to break aggregates, it is necessary that developer in the clearance q (shown in FIGS. 8A and 8B) is packed or compacted to the top on the downstream side in the second developer compartment 54Y. As long as this can be satisfied, the communicating portion 591 is not necessarily rectangular but can be shaped otherwise. For example, multiple circles or polygons may be arranged like a mesh.

Additionally, the above-described compacted state may be achieved by a combination with screw conditions. Therefore, the second conveying screw 56Y is not limited to the above-described configuration but can have any configurations (for example, pitch and winding number) capable of attaining developer balance to prevent shortage of developer in the first developer compartment 53Y.

As described above, the following effects can be attained by the present embodiment.

Aspect 1: A developing device includes a first developer compartment to supply developer to a developer bearer, such as the developing roller 51Y, the second developer compartment 54Y to agitate and send developer to the first developer compartment, first and second communicating portions, such as the opening 58 and the communicating portion 59, through which developer is circulated between the first and second developer compartments, and a second conveying screw, such as the second conveying screw 56Y, that transports developer in the second developer compartment. The second conveying screw includes the normal winding portion 56Ya, the reversed winding portion 56Yb, and the clearance q positioned between the normal winding portion 56Ya and the reversed winding portion 56Yb to send out developer therefrom. The screw pitch of the normal winding portion 56Ya is forward relative to the developer conveyance direction Y1 in which developer is transported to the first developer compartment 53Y. The screw pitch of the reversed winding portion 56Yb is reversed to the developer conveyance direction Y1, The second communicating portion (such as the communicating portion 591) to send developer from the second developer compartment 54Y to the first developer compartment 53Y includes two openings (such as the first and second portions 592 and 593) respectively disposed on the upstream side and the downstream side across the clearance q in the longitudinal direction of the developing device. With this configuration, a majority of developer does not reach the adjacent area of the midpoint Q where the stress is strong but is sent to the first developer compartment 53Y through the first portion 592. Accordingly, stress on developer can be alleviated. Further, the compacted state of developer in the area adjacent to the reversed winding portion 56Yb can be alleviated by the second portion 593.

Thus, excessive stress on developer can be alleviated while the capability to break toner aggregates is secured. Consequently, toner aggregate included in the supplied developer (i.e., supplied toner), coagulation generated in the developing device, or both can be loosened upstream from the communicating portion where developer is received in the first developer compartment on the side of the developer bearer without applying excessive stress to the developer.

Aspect 2: In aspect 1, the second conveying screw 56Y to agitate developer in the second developer compartment 54Y includes the normal winding portion 56Ya in which the screw pitch is forward in the developer conveyance direction Y1, the reversed winding portion 56Yb in which the screw pitch is reversed to the developer conveyance direction Y1, and the clearance q to send out developer between the normal winding portion 56Ya and he reversed winding portion 56Yb. The two openings (such as the first and second portions 592 and 593) together forming the second communicating portion through which developer is sent from the second developer compartment 54Y to the first developer compartment 53Y are respectively disposed facing the normal winding portion 56Ya and the reversed winding portion 56Yb across the clearance q. This configuration can attain effects similar to those attained by the above-described aspect 1.

Aspect 3: Since the width of the communicating portion 591 is wider than that of the clearance q, developer can be sent reliably.

Aspect 4: Since the second developer compartment 54Y is circular in cross section, immobile developer is not generated. As a result, developer can be transported through the range where the sliding force acts and then sent to the first developer compartment 53Y.

Aspect 5: A replenishing device, such as the toner replenishing device 31, to supply developer or toner to the first developer compartment is provided. Accordingly, in addition to loose coagulation generated in the developing device, loose coagulation included in the supplied developer (i.e., supplied toner) can be loosened upstream from the communicating portion where developer is received in the first developer compartment to supply developer to the developer bearer without applying excessive stress to the developer.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer configured to carry developer;

a first developer compartment including a first developer conveyor configured to convey developer in a first conveying direction in a longitudinal direction of the developing device, and to supply developer to the developer bearer;

a second developer compartment including an inlet portion configured to receive a supply of developer, and a second developer conveyor configured to convey developer in a second conveying direction opposite the first conveying direction from the inlet portion to an end portion of the second developer compartment; and first and second communicating portions configured to circulate developer between the first and second developer compartments;

wherein the second communicating portion includes multiple openings configured to pass developer from the end portion of the second developer compartment to the first developer compartment; and wherein a clearance between the second developer compartment and an outer edge of a screw blade of the second developer conveyor decreases in the second conveyance direction between the inlet portion and the end portion.

2. The developing device according to claim 1, wherein the multiple openings are through holes and comprise at least one of circular holes, square holes, rectangular slots, or oval holes.

3. The developing device according to claim 2, wherein the multiple openings are arranged at equal intervals.

4. The developing device according to claim 1, wherein the multiple openings are through holes which comprise a rectangular slot that is oriented either parallel, perpendicular, or oblique to a longitudinal direction of the first and second developer compartments.

5. The developing device according to claim 1, wherein the multiple openings have a short side length of 5 mm or shorter.

6. The developing device according to claim 1, further comprising a replenishing device to supply developer to the second developer compartment.

7. A process cartridge removably installable in an image forming apparatus, the process cartridge comprising the developing device according to claims 1; and at least one of an image bearer, a charging member to charge the image bearer, and a cleaning unit to clean the image bearer.

8. The developing device according to claim 1 wherein:

the first developer compartment is disposed between the developer bearer and the second developer compartment.

9. The developing device according to claim 1 further comprising:

a supply inlet disposed at the second developer compartment and upstream from the second communicating potion in a developer conveying direction in the second developer compartment, the supply inlet through which developer is supplied to the second developer compartment; and wherein, in the second developer compartment, a level of developer at a position of the supply inlet in the developer conveying direction is lower than a level of developer at a position of the second communicating portion in the developer conveying direction.

10. The developing device of claim 1 wherein:

wherein a shape formed by the inner walls of the second developer compartment transitions from a non-circular shape to a circular shape in the second conveyance direction at a location downstream from the inlet portion and upstream from the communicating portion.

11. The developing device of claim 10 wherein:

wherein the clearance throughout the circular shape of the second developer compartment is smaller than the clearance throughout the non-circular shape.

12. The developing device of claim 11 wherein:

wherein the clearance is a non-zero distance throughout the second developer Compartment.

13. A developing device of an image forming unit comprising:

a replenishment-side compartment configured to receive toner from a toner cartridge, to mix the toner with developer, to convey the developer in a longitudinal direction of the developing device with a screw, and to transport the developer through a screen with multiple holes; and a supply-side compartment configured to receive the developer through the screen, to convey the developer in the longitudinal direction of the developing device, and to transport the developer to a developing roller;

wherein the screen is formed in a partition between the replenishment-side compartment and the supply-side compartment; and wherein a clearance between the replenishment-side compartment and an outer edge of a blade of the screw decreases in the longitudinal direction.

14. The developing device of claim 13 wherein:

the replenishment-side compartment includes a first portion configured to receive developer returned from the supply-side compartment.

15. The developing device of claim 14 wherein:

the replenishment-side compartment includes a second portion configured to receive the toner from the toner cartridge.

16. The developing device of claim 15 wherein:

the replenishment-side compartment includes a third portion configured with a partition to send the developer through the screen.

17. A developing device comprising:

a first developer compartment to supply developer to a developer bearer;

a second developer compartment to agitate the developer, and to send the developer to the first developer compartment;

first and second communicating portions through which developer is circulated between the first and second developer compartments;

a conveying screw in the second developer compartment to transport developer through a longitudinal direction of the developing device in a conveyance direction; and wherein a clearance between the second developer compartment and an outer edge of a blade of the conveying screw decreases in the longitudinal direction.

* * * * *